US010916902B2

(12) United States Patent
Maki

(10) Patent No.: US 10,916,902 B2
(45) Date of Patent: Feb. 9, 2021

(54) COAXIAL CONNECTOR ASSEMBLY

(71) Applicant: HIROSE ELECTRIC CO., LTD., Tokyo (JP)

(72) Inventor: Kentaro Maki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/569,097

(22) Filed: Sep. 12, 2019

(65) Prior Publication Data

US 2020/0091665 A1 Mar. 19, 2020

(30) Foreign Application Priority Data

Sep. 14, 2018 (JP) ..... 2018-172082

(51) Int. Cl.
*H01R 24/50* (2011.01)
*H01R 13/50* (2006.01)
(Continued)

(52) U.S. Cl.
CPC ..... *H01R 24/50* (2013.01); *H01R 13/111* (2013.01); *H01R 13/42* (2013.01); *H01R 13/50* (2013.01);
(Continued)

(58) Field of Classification Search
CPC ..... H01R 24/50
See application file for complete search history.

(56) References Cited

U.S. PATENT DOCUMENTS 6,497,579 B1 * 12/2002 Garbini ..... H01R 13/6315 439/63
7,952,449 B2 * 5/2011 Yagisawa ..... H01P 5/026 333/244
8,801,459 B2 * 8/2014 Mrowka ..... H01R 24/54 439/246

FOREIGN PATENT DOCUMENTS

CN 103855561 6/2014
CN 206947679 1/2018
JP 10-233266 9/1998

OTHER PUBLICATIONS

Chinese First Office Action (CNOA) dated Sep. 16, 2020, for the corresponding Chinese Patent Application No. 201910864275.2.

* cited by examiner

*Primary Examiner* — Ross N Gushi
(74) *Attorney, Agent, or Firm* — Rankin, Hill & Clark LLP

(57) ABSTRACT

[PROBLEMS] To provide a coaxial connector assembly maintaining a characteristic impedance and allowing floating.
[SOLUTION] First to third coaxial connectors 10 to 30 are provided. A second center conductor 23 of the second coaxial connector 20 has a second shaft portion 23A held by a second dielectric body 22, a right columnar one-end-side contact portion 23B to be fitted in a first receiving portion 13B of the first coaxial connector 10, and the other-end-side contact portion 23C to be fitted in a third center contact portion 33B of the third coaxial connector 30. The one-end-side contact portion 23B is larger than the outer diameter of the second shaft portion 23A. A distance in a radial direction between the one-end-side contact portion 23B and a first fitting portion 11B of a first external conductor 13 is impedance-matched to an impedance between a first center conductor 13 and the periphery thereof and an impedance
(Continued)

between the second shaft portion 23A of the second center conductor 23 and the periphery thereof. The first and second coaxial connectors 10, 20 and the second and third coaxial connectors 20, 30 form floating structures.

9 Claims, 8 Drawing Sheets

(51) Int. Cl.

| | |
|---|---|
| ***H01R 13/502*** | (2006.01) |
| ***H01R 13/11*** | (2006.01) |
| ***H01R 13/42*** | (2006.01) |
| ***H01R 13/629*** | (2006.01) |
| *H01R 103/00* | (2006.01) |

(52) U.S. Cl.
CPC ..... *H01R 13/502* (2013.01); *H01R 13/629* (2013.01); *H01R 2103/00* (2013.01)

COAXIAL CONNECTOR ASSEMBLY

TECHNICAL FIELD

The present invention relates to a coaxial connector assembly configured such that coaxial connectors are fitted and connected to each other.

BACKGROUND ART

In a coaxial connector assembly, when fitting of one coaxial connector and the other coaxial connector is not performed at a proper position in an axial direction of the coaxial connector assembly, a characteristic impedance in the coaxial connector assembly might fluctuate from a predetermined value due to structures of both coaxial connectors, leading to an unpreferable connection situation.

For example, in a structure illustrated in FIG. 4 of Patent Literature 1 as a typical technique of Patent Literature 1, a center conductor of one coaxial connector and a dielectric body holding the center conductor have end surfaces at the same position in an axial direction, and in a state in which a center conductor of the other coaxial connector is fitted in the center conductor of one coaxial connector, the center conductor of the other coaxial connector has a flange-shaped projecting portion facing the end surface of one coaxial connector in the axial direction. Patent Literature 1 has pointed out that when fitting of both coaxial connectors is not performed at a proper position in the axial direction under this structure, a clearance spacing in the axial direction between a dielectric body surface at the end surface of one coaxial connector and a flange-shaped projecting portion surface formed at the center conductor of the other coaxial connector changes due to the projecting portion and there is a problem that a characteristic impedance fluctuates.

For this reason, in Patent Literature 1, a contact surface (an outer peripheral surface) of the center conductor of the other coaxial connector is, without providing the flange-shaped projecting portion at such a center conductor, provided as a line stretcher formed in a right columnar shape and having a constant outer diameter regardless of a position in the axial direction, and an inner peripheral surface of an external conductor of one coaxial connector as a partner positioned outside in a radial direction with respect to the line stretcher also has a constant inner diameter regardless of a position in the axial direction. With this configuration, even when the clearance spacing in the axial direction has changed, the radial thickness of an air layer between the periphery of the line stretcher and the external conductor is constant regardless of the position in the axial direction, and the characteristic impedance is maintained at a predetermined value.

CITATION LIST

Patent Literature

[PATENT LITERATURE 1] JP-A-10-233266

SUMMARY OF THE INVENTION

Problems to be Solved by the Invention

According to Patent Literature 1, in an axial area where the line stretcher is exposed to the air layer at the periphery of the line stretcher, even when the clearance spacing in the axial direction fluctuates, the thickness of the air layer in the radial direction is constant regardless of the position in the axial direction, and therefore, the characteristic impedance is maintained.

However, such a coaxial connector assembly is often used for connecting two connection target instruments or members to be connected through this coaxial connector assembly, such as two circuit boards. In the case of such a use application, the coaxial connector assembly of Patent Literature 1 can be applied in a case where a connection position between two connection target instruments or members is merely shifted from a predetermined position only in the axial direction as a connection direction, but cannot be applied for shift in a direction at a right angle to the axial direction.

The present invention has been made in view of the above-described situation, and an object of the present invention is to provide a coaxial connector assembly having a floating structure which can maintain a characteristic impedance at a predetermined value even when the coaxial connector assembly is shifted in an axial direction and can handle not only shift in the axial direction but also shift in a direction at a right angle to the axial direction.

Solutions to the Problems

The coaxial connector assembly according to the present invention is configured such that a first center conductor is held by a first external conductor through a first dielectric body, a second coaxial connector configured such that a second center conductor is held by a second external conductor through a second dielectric body, and a third coaxial connector configured such that a third center conductor is held by a third external conductor through a third dielectric body and configured such that the third coaxial connector is fitted in and connected to the first coaxial connector in a single axial direction through the second coaxial connector.

In the present invention, in such a coaxial connector assembly, the first center conductor is configured such that a first receiving portion configured to receive the second center conductor of the second coaxial connector is formed in a tubular hole shape extending straight in the axial direction, the first external conductor has a first holding portion configured to hold the first center conductor through the first dielectric body and a first fitting portion protruding toward the second coaxial connector with respect to the first dielectric body and the first center conductor in the axial direction and fitted onto one end portion of the second external conductor of the second coaxial connector, and the first fitting portion is formed with a smaller inner diameter than the inner diameter of the first holding portion. The second center conductor of the second coaxial connector has a second shaft portion held by the second dielectric body in the second external conductor, a right columnar one-end-side contact portion protruding toward the first coaxial connector with respect to the second dielectric body and the second external conductor in the axial direction and provided at one end portion of the second center conductor on a first coaxial connector side to fit in the first receiving portion of the first coaxial connector, and the other-end-side contact portion formed at the other end portion of the second center conductor on a third coaxial connector side to fit in a third center contact portion provided at one end portion of the third center conductor of the third coaxial connector. The second center conductor is configured such that the outer diameter of the one-end-side contact portion is formed larger than the outer diameter of the second shaft portion and a distance in a radial direction between the one-end-side contact portion and the first fitting portion of the first external conductor is impedance-matched to an impedance between the first center conductor and the periphery thereof and an impedance between the second shaft portion of the second center conductor and the periphery thereof. The third coaxial connector is configured such that the third external conductor is fitted onto the other end portion of the second external conductor. The first and second coaxial connectors and the second and third coaxial connectors form floating structures relatively movable in the axial direction and the radial direction.

According to the present invention with such a configuration, the one-end-side contact portion of the second center conductor (the second coaxial connector) and the first fitting portion of the first external conductor (the first coaxial connector) positioned outside of the one-end-side contact portion in the radial direction have, in an exposed area (a spacing in the axial direction between the first center conductor and the second dielectric body) of the one-end-side contact portion in the axial direction, constant diameters regardless of a position in the axial direction. Thus, the radial thickness of an air layer around an exposed area portion of the one-end-side contact portion is constant, and even when the distance of the exposed area in the axial direction (the spacing in the axial direction) changes, the thickness of the air layer does not change. As a result, a predetermined characteristic impedance is maintained.

Further, in the present invention, the floating structure is formed between the second coaxial connector and each of the first coaxial connector and the third coaxial connector. Thus, even when the spacing in the axial direction changes in a state in which the predetermined characteristic impedance is maintained as described above, floating characteristics are ensured not only in the axial direction but also in the radial direction, i.e., a direction at a right angle to the axial direction.

In the present invention, the floating structures can be configured such that each contact area between the first receiving portion at the first center conductor of the first coaxial connector and the one-end-side contact portion of the second center conductor of the second coaxial connector, between the first fitting portion at the first external conductor of the first coaxial connector and one end portion of the second external conductor of the second coaxial connector, between the other-end-side contact portion of the second center conductor of the second coaxial connector and the third center conductor of the third coaxial connector, and between the other end portion of the second external conductor of the second coaxial connector and the third external conductor of the third coaxial connector is formed in a local area in the axial direction allowing inclination about such a contact area as the point of support.

In such a floating structure, the contact area is in the local area in the axial direction, and therefore, two members forming the contact area can tiltably float about the contact area as the point of support.

In the present invention, one of two members forming each contact area preferably has a slitting groove extending in the axial direction at at least a single spot in a circumferential direction. With this configuration, inclination about the contact area as the point of support is facilitated by elastic diameter expansion of the member provided with the slitting groove.

In the present invention, the third external conductor of the third coaxial connector can form, in cooperation with the second external conductor of the second coaxial connector, a lock mechanism configured to prevent detachment. With such a lock mechanism, the third coaxial connector and the second coaxial connector can be integrated such that the first coaxial connector is freely inserted into or detached from the second coaxial connector. When the first coaxial connector is detached from the second coaxial connector, the second coaxial connector constantly remains on the third coaxial connector side, and the operation of inserting or detaching only the first coaxial connector is reliably performed.

In the present invention, the first coaxial connector can be configured such that the first center conductor has a first center connection portion to be soldered and connected to a circuit board and the first external conductor has a first external connection portion to be soldered and connected to the circuit board. Moreover, the third coaxial connector can be configured such that the third center conductor has a third center connection portion to be soldered and connected to another circuit board and the third external conductor has a third external connection portion to be soldered and connected to the another circuit board. In such a structure, floating between both circuit boards is allowed in any direction of three axes.

Moreover, in the present invention, the second external conductor of the second coaxial connector and the third external conductor of the third coaxial connector can be formed as a single member, the second center conductor of the second coaxial connector and the third center conductor of the third coaxial connector can be formed as a single member, and the second coaxial connector and the third coaxial connector can form a single connector. In such a form, the function of the floating structure can be also obtained.

Effects of the Invention

As described above, the present invention is the coaxial connector assembly configured such that the third coaxial connector is fitted in and connected to the first coaxial connector in the single axial direction through the second coaxial connector. The second center conductor is configured such that the outer diameter of the right columnar one-end-side contact portion is formed larger than the outer diameter of the second shaft portion and the distance in the radial direction between the one-end-side contact portion and the first fitting portion of the first external conductor is impedance-matched to the impedance between the first center conductor and the periphery thereof and the impedance between the second shaft portion of the second center conductor and the periphery thereof. The first and third coaxial connectors and the second and third coaxial connectors form the floating structures relatively movable in the axial direction and the radial direction. Thus, the one-end-side contact portion of the second center conductor at the second coaxial connector and the first fitting portion of the first external conductor at the first coaxial connector positioned outside of the second coaxial connector in the radial direction have, in the exposed area of the one-end-side contact portion in the axial direction in the spacing in the axial direction between the first center conductor and the second dielectric body, the constant diameters regardless of the position in the axial direction, and the radial thickness of the air layer around the exposed area portion of the one-end-side contact portion is constant. As a result, even when the spacing of the exposed area in the axial direction changes, the thickness of the air layer does not change, and the predetermined characteristic impedance is maintained. In addition, the floating structure is formed between the second coaxial connector and each of the first coaxial connector and the third coaxial connector. Thus, the effect of ensuring the floating characteristics not only in the axial direction but also in the radial direction, i.e., the direction at the right angle to the axial direction, even when the spacing in the axial direction changes is obtained.

DESCRIPTION OF THE EMBODIMENTS

Hereinafter, an embodiment of the present invention will be described with reference to the attached drawings.

Figure 1:
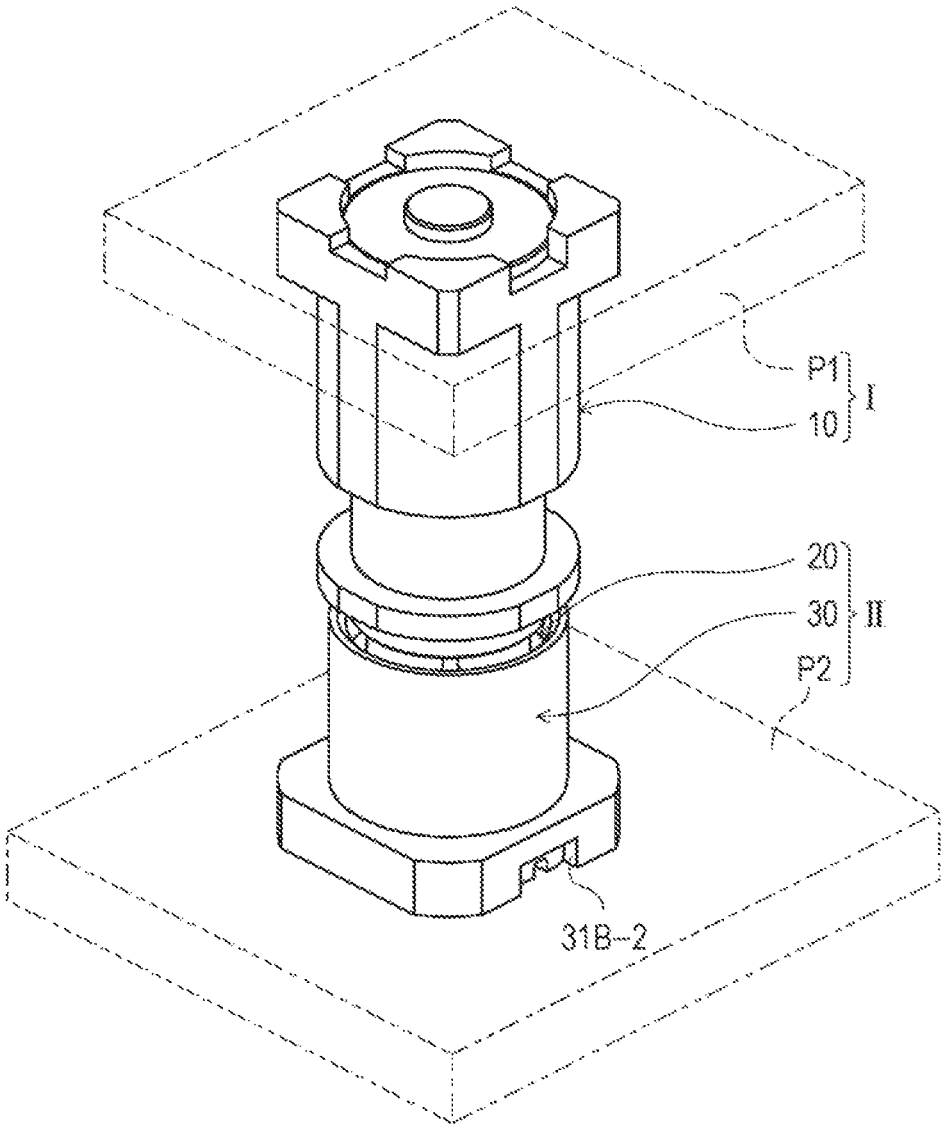
FIG. 1 illustrates, as the form of connecting two circuit boards, a perspective view of a coaxial connector assembly configured such that an upper connector mount body and a lower connector mount body are connected to each other as one embodiment of the present invention.

A coaxial connector assembly of the present embodiment has, as illustrated in FIG. 1, a first coaxial connector 10, a second coaxial connector 20, and a third coaxial connector 30. The coaxial connector assembly includes an upper connector mount body I formed such that the first coaxial connector 10 is mounted on a circuit board P1 positioned above the first coaxial connector 10, and a lower connector mount body 11 formed such that the second coaxial connector 20 and the third coaxial connector 30 are joined to each other in a lock state and the third coaxial connector 30 is mounted on another circuit board P2 positioned below the third coaxial connector 30. Note that in FIG. 1, the circuit boards P1, P2 indicated by chain double-dashed lines are illustrated with other regions than a region of the upper connector mount body I on which the lower connector mount body II is mounted being omitted.

Figure 2:
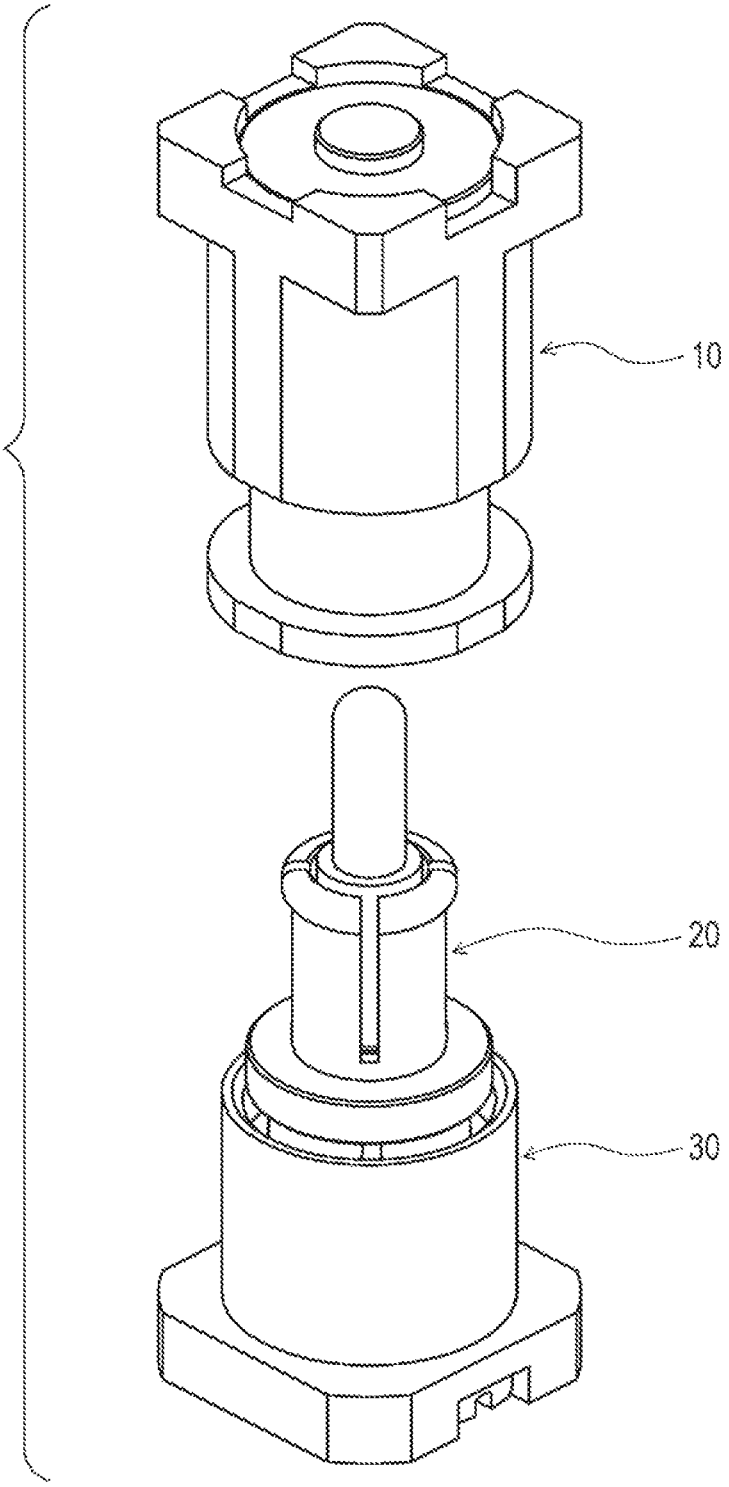
FIG. 2 is, in a state in which the circuit boards are not shown in the figure, a perspective view of the coaxial connector assembly of FIG. 1, FIG. 2 illustrating a first coaxial connector of the upper connector mount body before connection and a second coaxial connector and a third coaxial connector connected to each other as the lower connector mount body.
Figure 3:
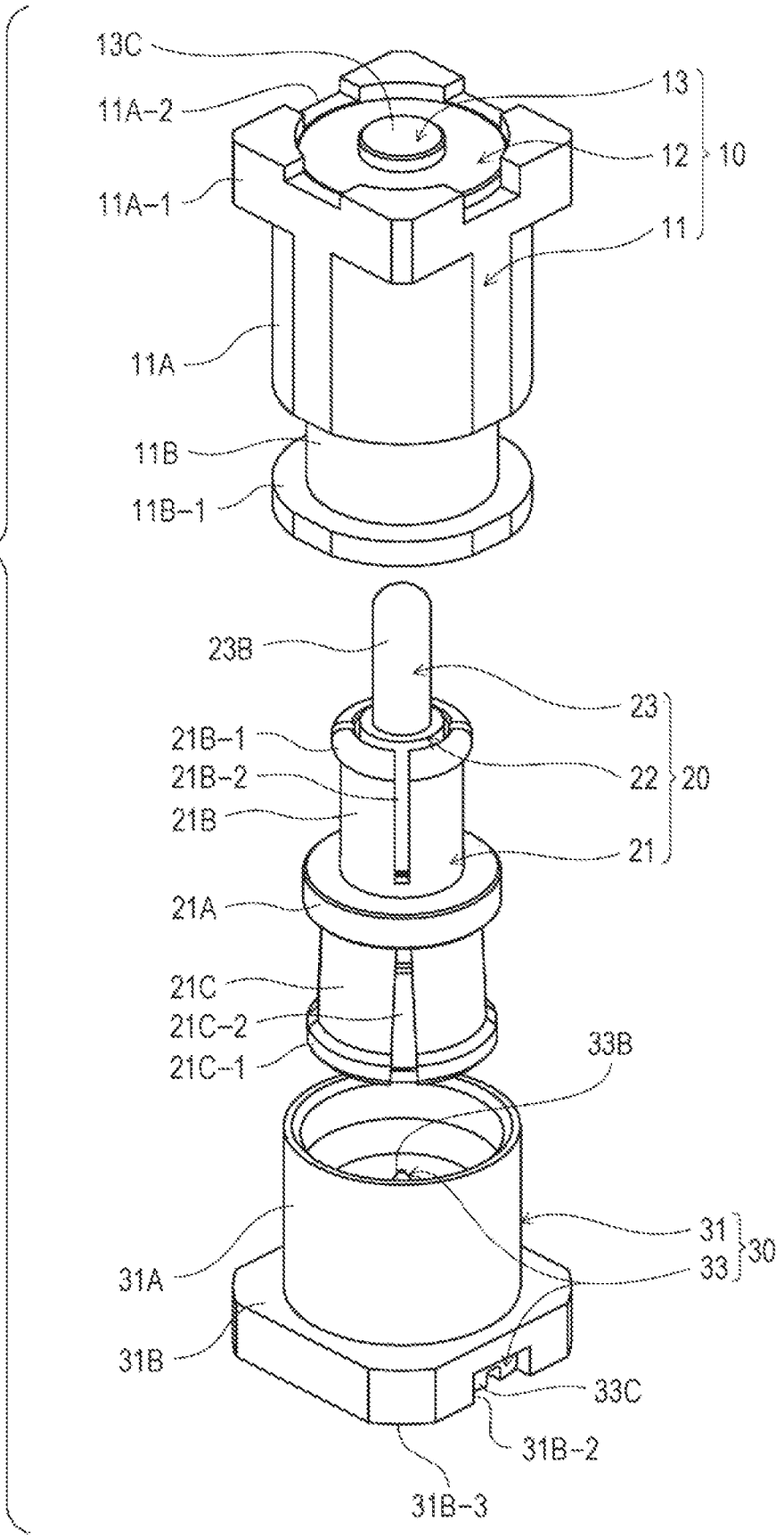
FIG. 3 is a perspective view of the first coaxial connector of FIG. 2 and the second and third coaxial connectors before connection.

FIG. 2 illustrates the first coaxial connector 10 with the circuit board P1 of a first connector mount body I of FIG. 1 being not shown in the figure, and illustrates the second coaxial connector 20 and the third coaxial connector 30 joined to each other in a state separated from the first coaxial connector 10 with the circuit board P2 being not shown in the figure. FIG. 3 further illustrates the second coaxial connector 20 and the third coaxial connector 30 in a separated state.

Of the first coaxial connector 10, the second coaxial connector 20, and the third coaxial connector 30 illustrated separately in FIG. 3, the first coaxial connector 10 is, upon use, mounted on the circuit board P1 to form the upper connector mount body I while the second coaxial connector 20 and the third coaxial connector 30 are integrally joined (see FIG. 2) to each other in an axial direction (an upper-to-lower direction in the figure). Thereafter, the third coaxial connector 30 is mounted on another circuit board P2 to form the lower connector mount body 11, or the second coaxial connector 20 is joined to the third coaxial connector 30 after the third coaxial connector 30 has been mounted on another circuit board P2 to form the lower connector mount body II.

Figure 4:
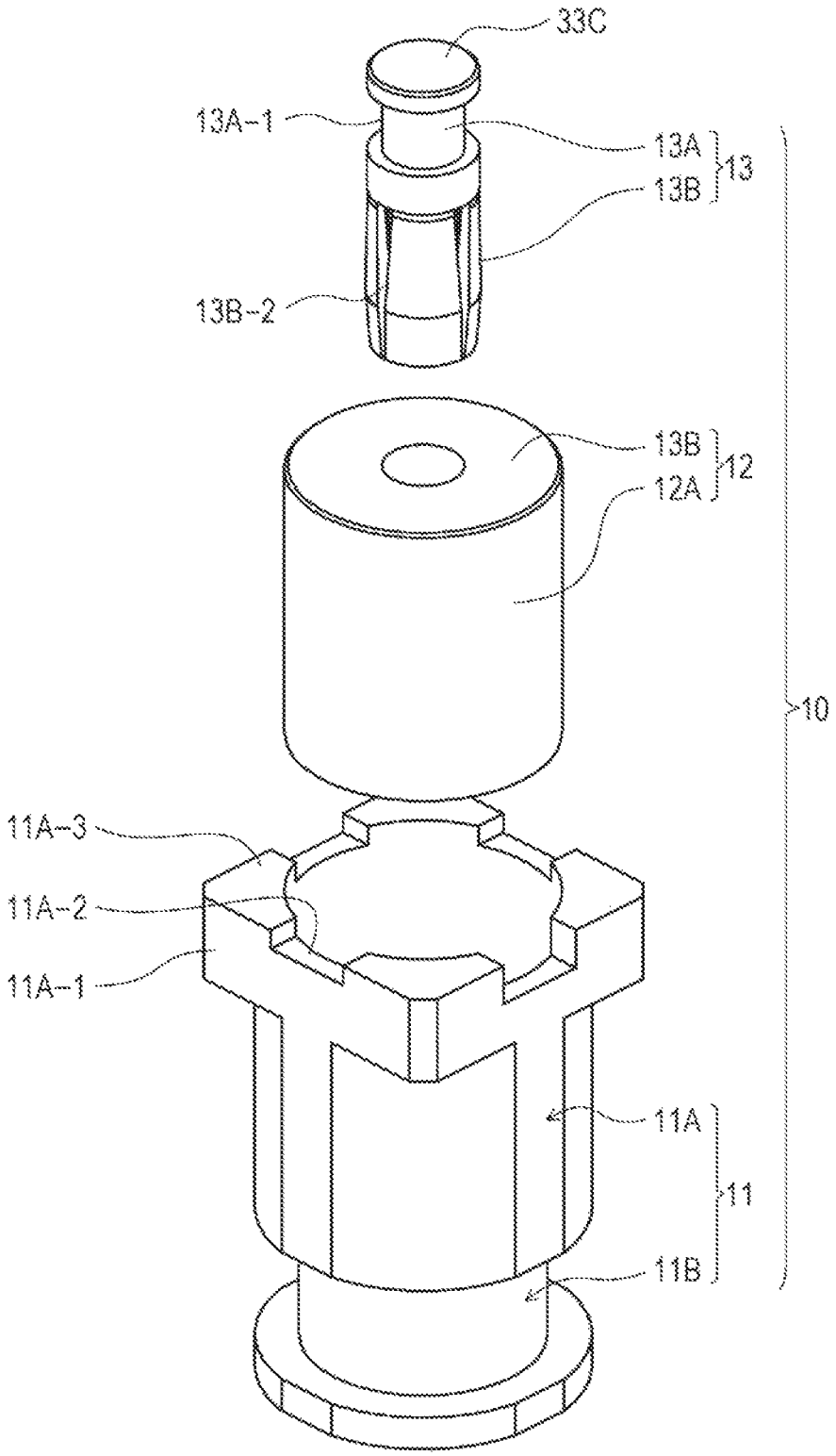
FIG. 4 is a perspective view of a first external conductor, a first dielectric body, and a first center conductor of the first coaxial connector in a separated state.

Hereinafter, the first coaxial connector 10, the second coaxial connector 20, and the third coaxial connector 30 will be sequentially described with reference to FIGS. 3, 4, and 5. FIG. 4 illustrates the first coaxial connector 10 illustrated in FIGS. 2 and 3 with the first coaxial connector 10 being separated into each component, and FIG. 6 is a sectional view along a plane passing through the axis of the first coaxial connector 10 obtained by assembly of these members. Note that upon description of the first coaxial connector 10, the second coaxial connector 20, and the third coaxial connector 30, each of these components will be, as necessary, described with a "first" for the first coaxial connector 10, a "second" for the second coaxial connector 20, or a "third" for the third coaxial connector 30 for clearly distinguishing these connectors.

The first coaxial connector 10 is configured such that a metal first center conductor 13 is held through a first dielectric body 12 made of an electric insulating material in a stepped cylindrical metal first external conductor 11.

The first external conductor 11 has a first holding portion 11A forming an upper half of the first external conductor 11 and housing and holding the dielectric body 12 inside, and a first fitting portion 11B forming a lower half of the first external conductor 11, forming a step with respect to the first holding portion 11A, and formed in a small-diameter cylindrical shape. An annular flange portion 11B-1 radially protruding outward is provided at the outer periphery of a lower end of the first fitting portion 11B, and a tapered surface 11B-2 is formed at the inner periphery of an opening of the lower end (see FIG. 6).

As illustrated in FIG. 4, a protruding portion 11A-1 radially protruding outward from an upper end of the first holding portion 11A and having a rectangular outer shape is provided at the first external conductor 11. Recessed portions 11A-2 are formed at four spots of the protruding portion 11A-1 in a circumferential direction, and a raised upper surface positioned between adjacent ones of the recessed portions 11A-2 is a first external connection portion 11A-3 to be soldered and connected in contact with the circuit board P1.

The first dielectric body 12 held in the first holding portion 11A of the first external conductor 11 has a first holding target tubular portion 12A configured to contact an inner surface of the first holding portion 11A, and a first center conductor holding portion 12B radially projecting inward of the first holding target tubular portion 12A at an upper position of the first holding portion 11A.

The first center conductor 13 has a first shaft portion 13A to be held by an inner peripheral surface of the first center conductor holding portion 12B of the first dielectric body 12, and a first receiving portion 13B protruding in the axial direction from the first shaft portion 13A toward the second coaxial connector 20. Of the first shaft portion 13A, an outer peripheral surface of a middle portion in the axial direction forms an annular recessed portion 13A-1 such that the first shaft portion 13A is reliably held not only in a radial direction but also in the axial direction (the upper-to-lower direction as viewed in the figure) by the first center conductor holding portion 12B of the first dielectric body 12. An upper surface of the first shaft portion 13A forms a first center connection portion 13C to be soldered and connected to the circuit board P1. The first receiving portion 13B extends in the axial direction across the area of the first holding target tubular portion 12A of the first dielectric body 12, and forms an air layer A having a predetermined spacing in the radial direction between an outer peripheral surface of the first receiving portion 13B and the first holding target tubular portion 12A of the dielectric body 12. The first receiving portion 13B is in a tubular shape to form a first receiving hole portion 13B-1 opening toward the second coaxial connector 20 and closed on a first shaft portion 13A side. Slitting grooves 13B-2 extending in the axial direction at multiple positions in the circumferential direction are formed at the first receiving portion 13B, and therefore, the diameter of the first receiving portion 13B can be elastically narrowed or expanded in the radial direction. At an inner surface of an opening edge (a lower edge as viewed in the figure) of the first receiving portion 13B, a later-described tapered surface 13B-3 facilitating receiving of the second center conductor of the second coaxial connector 20 is formed (see FIG. 6).

Figure 5:
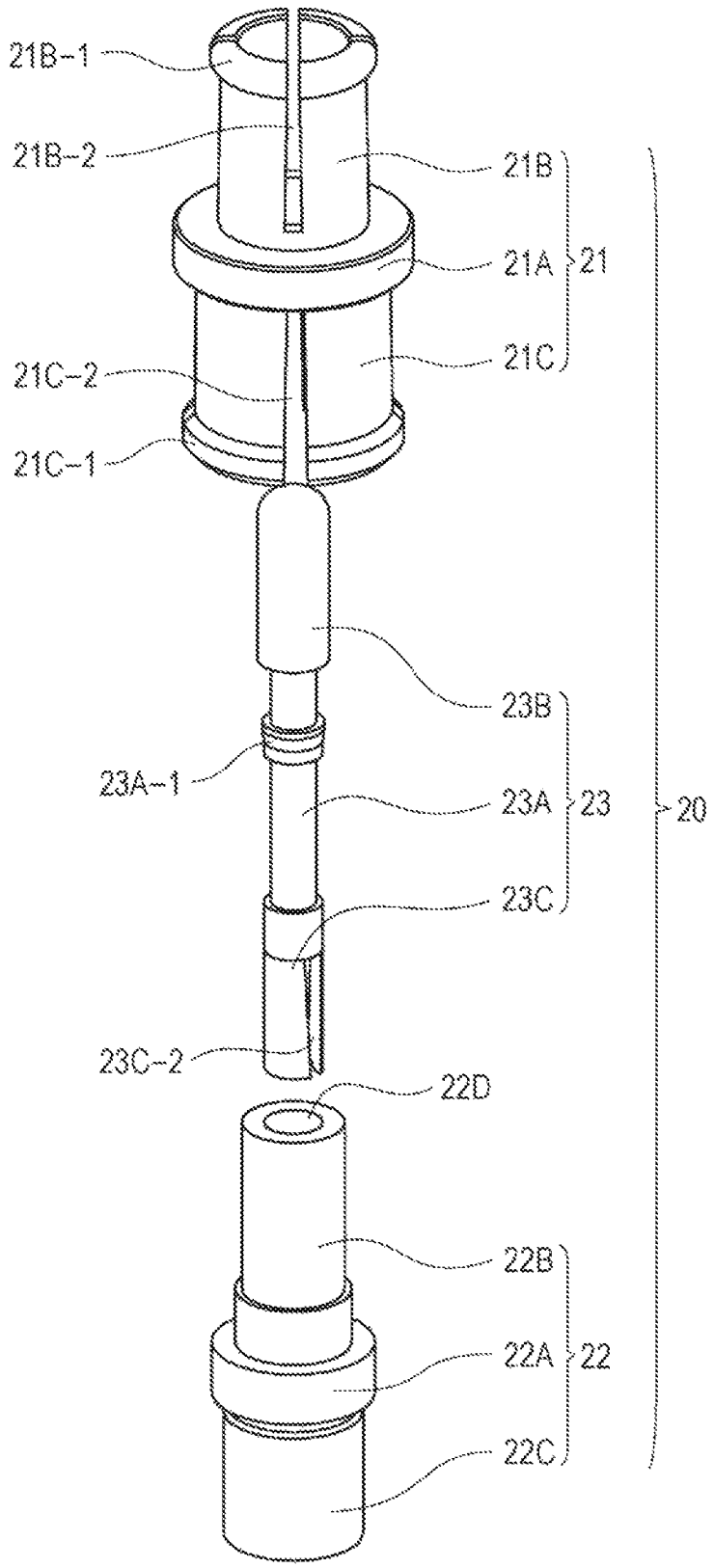
FIG. 5 is a perspective view of a second external conductor, a second dielectric body, and a second center conductor of the second coaxial connector in a separated state.
Figure 6:
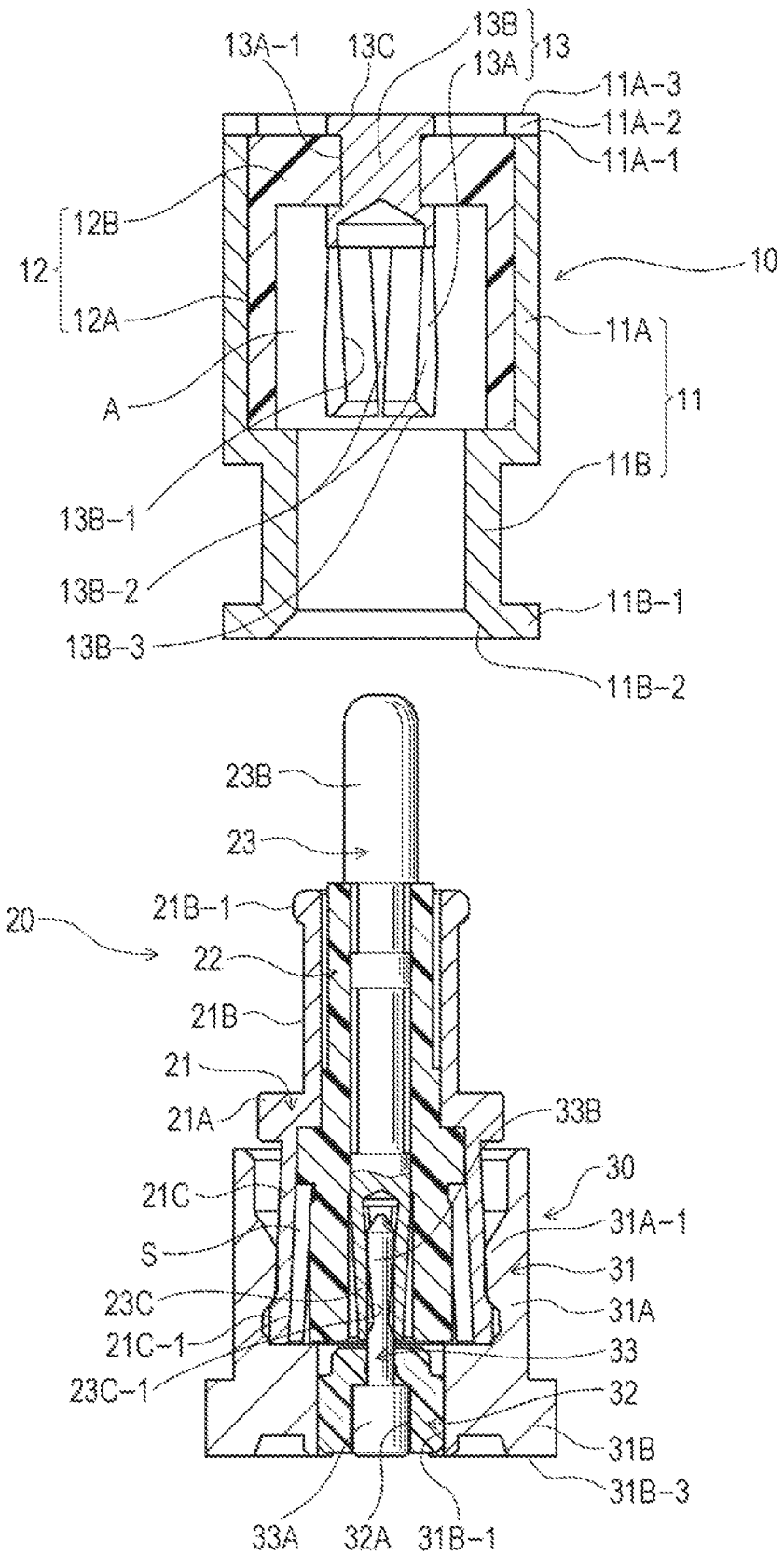
FIG. 6 is a sectional view of the connectors of FIG. 2 along a plane including an axis.
Figure 7:
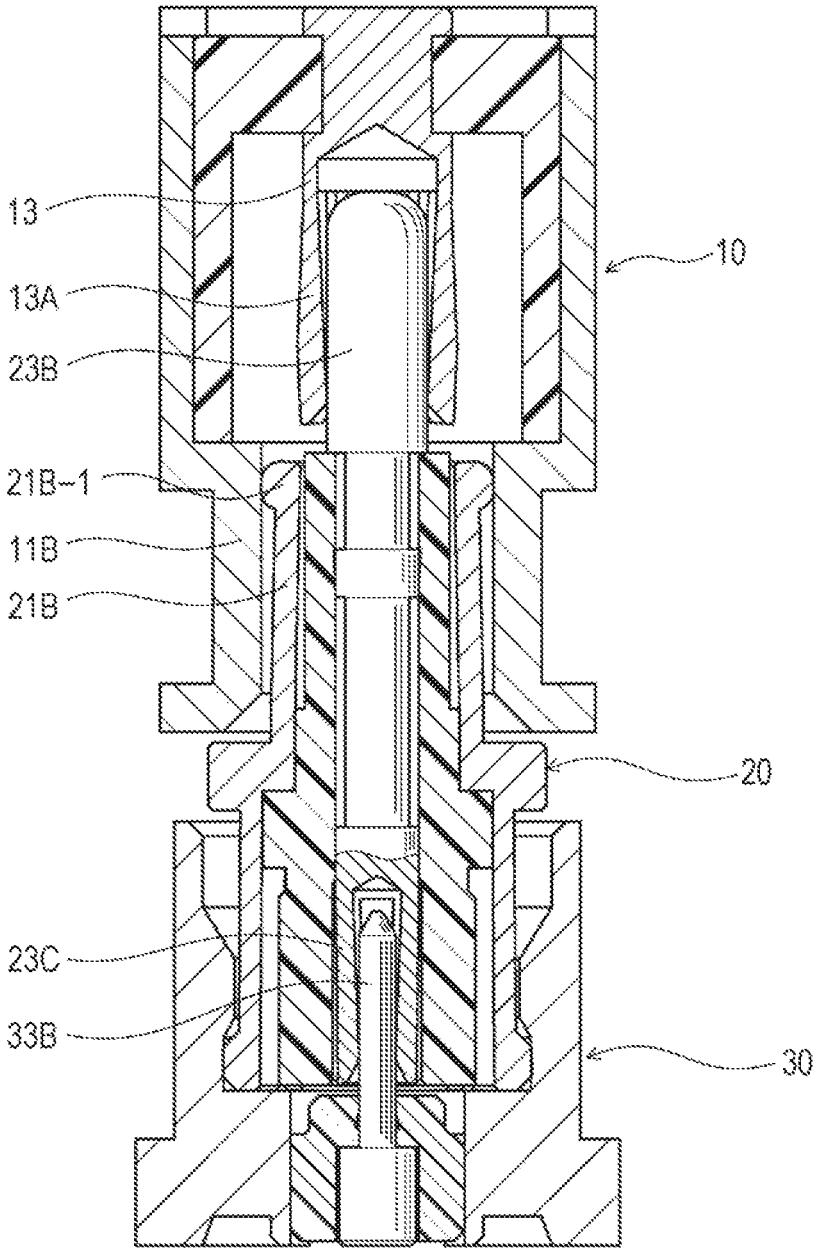
FIG. 7 is a sectional view along the plane including the axis in a state after connection of the connectors of FIG. 6.
Figure 8:
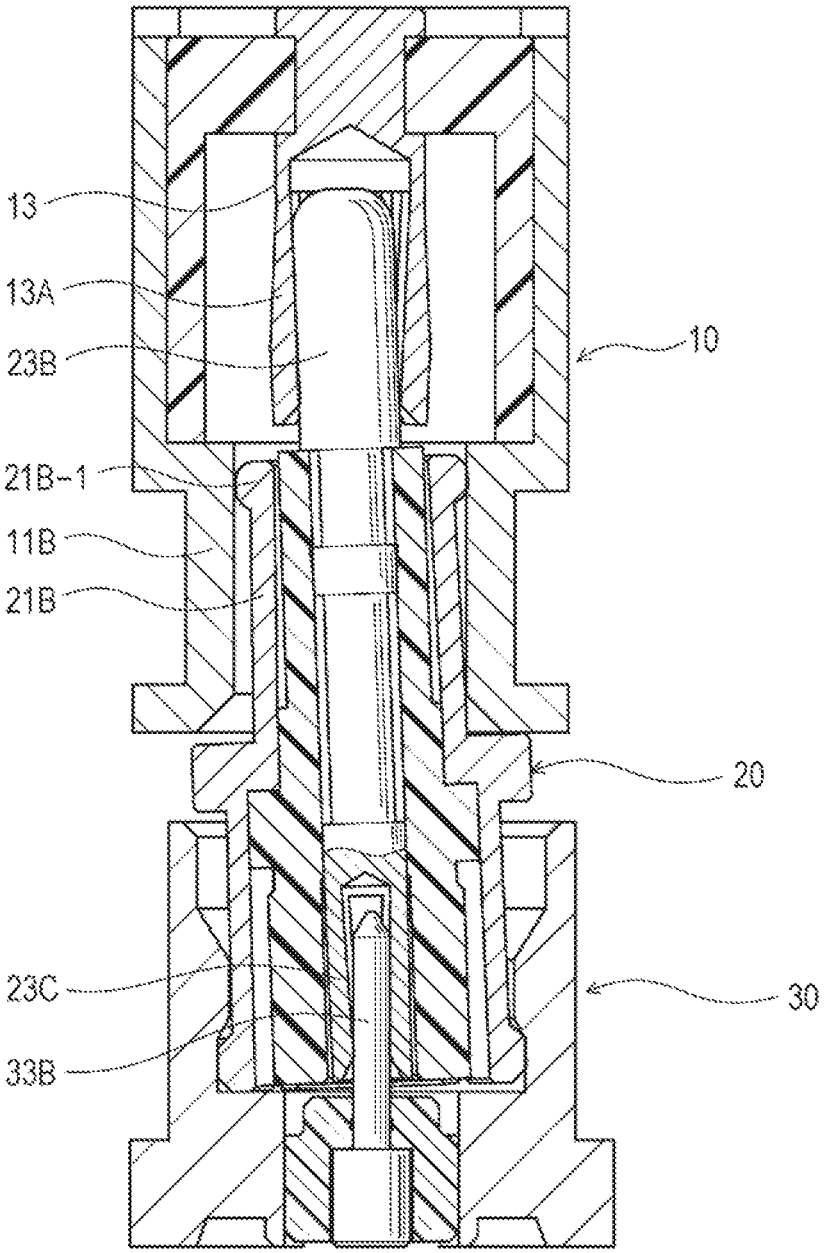
FIG. 8 is a sectional view along the plane including the axis when the connectors of FIG. 7 are shifted from a regular connection position in a direction at a right angle to an axial direction.

As seen from FIGS. 3, 5, and 6, the second coaxial connector 20 has a metal second external conductor 21, a second dielectric body 22 made of an electric insulating material, and a metal second center conductor 23.

The second external conductor 21 has an upper fitting portion 21B above an annular flange 21A provided at a middle position in the axial direction and a lower fitting portion 21C below the flange 21A, and the lower fitting portion 21C has a larger inner diameter and a larger outer diameter than those of the upper fitting portion 21B. The outer diameter of the flange 21A is larger than that of the lower fitting portion 21C.

At the upper fitting portion 21B, a one-end-side contact portion 21B-1 formed as an annular protruding portion is provided at one end in the axial direction as an upper end, i.e., at an end portion on a first coaxial connector 10 side. The one-end-side contact portion 21B-1 is in such a shape that a sectional shape in the plane including the axis is in a curved shape raised radially outwardly, and the maximum diameter of the one-end-side contact portion is slightly larger than the inner diameter of the first fitting portion 11B provided at the first external conductor 11 of the first coaxial connector 10. Slitting grooves 21B-2 opening at the upper end are formed at four spots in the circumferential direction across the entire length of the upper fitting portion 21B in the axial direction at the upper fitting portion 21B, and therefore, elastic deformation (diameter narrowing and expansion) of the upper fitting portion 21B in the radial direction is allowed.

The one-end-side contact portion 21B-1 is configured such that a maximum-outer-diameter portion at a top portion of the raised curved shape forms, as an extremely-narrow local area in the axial direction, a contact area for an inner surface of the first fitting portion 11B.

The lower fitting portion 21C forms such a tapered tubular portion that an outer diameter gradually increases downward, i.e., toward the third coaxial connector 30, and a locking protruding portion 21C-1 formed as an annular protruding portion is formed at a lower end of an outer peripheral surface of the lower fitting portion 21C. The outer peripheral surface of the lower fitting portion 21C forms, at a middle position in the axial direction, a connection area in a narrow local area in the axial direction between such an outer peripheral surface and a later-described third external conductor 31 of the third coaxial connector 30.

At the lower fitting portion 21C, the locking protruding portion 21C-1 formed as the annular protruding portion is provided at the other end in the axial direction as a lower end, i.e., an end portion on a third coaxial connector 30 side. The locking protruding portion 21C-1 is in such a shape that a sectional shape in the plane including the axis is in a trapezoidal shape facing radially outwardly, and the maximum outer diameter of the locking protruding portion is slightly larger than the inner diameter of a later-described third locking portion provided at the third external conductor 31 of the third coaxial connector 30. Slitting grooves 21C-2 opening at the lower end are formed at four spots in the circumferential direction across the entire length of the lower fitting portion 21C in the axial direction at the lower fitting portion 21C, and therefore, elastic deformation (diameter narrowing and expansion) of the lower fitting portion 21C in the radial direction is allowed.

The second dielectric body 22 is held in the second external conductor 21, and the second external conductor 21 holds the second center conductor 23 through the second dielectric body 22. The second center conductor 23 is press-fitted in the second dielectric body 22.

At the second dielectric body 22, a right cylindrical holding portion 22B having a smaller outer diameter than that of a flange 22A provided at a middle portion in the axial direction is provided above the flange 22A, and an extension portion 22C having a smaller outer diameter than that of the flange 22A but having a larger outer diameter than that of the holding portion 22B and extending downwardly is provided below the flange 22A. The inner diameter 22D of the second dielectric body 22 is the same diameter from an upper end to a lower end, and is an inner diameter suitable for press-fitting a later-described holding target portion 23A-1 of the second center conductor 23.

The flange 22A of the second dielectric body 22 is positioned above the lower fitting portion 21C of the second external conductor 21 in the axial direction, and in the axial direction, contacts a step portion at a boundary between the upper fitting portion 21B and the lower fitting portion 21C (see FIG. 6). The extension portion 22C of the second dielectric body 22 is smaller than the inner diameter of the lower fitting portion 21C of the second external conductor 21, and forms an annular space S between the extension portion 22C and the lower fitting portion 21C. The space S allows elastic diameter narrowing of the lower fitting portion 21C of the second external conductor 21.

The second center conductor 23 has a second shaft portion 23A held by the second dielectric body 22 in the second external conductor 21, a right columnar one-end-side contact portion 23B provided at one end portion of the second center conductor 23 on the first coaxial connector side protrude toward the first coaxial connector 10 with respect to the second dielectric body 22 and the second external conductor 21 in the axial direction and fit in the first receiving hole portion 13B-1 of the first receiving portion 13B of the first coaxial connector 10 (also see FIG. 6), and the other-end-side contact portion 23C formed at the other end portion of the second center conductor 23 on the third coaxial connector side to fit in a later-described third center contact portion provided at one end portion of a third center conductor of the third coaxial connector 30.

The second shaft portion 23A is not held by the second dielectric body 22 across an entire area in the axial direction, but is held in such a manner that the holding target portion 23A-1 formed as an annular protruding portion at part of the area of the second shaft portion 23 in the axial direction is press-fitted in the inner diameter of the holding portion 22B of the second dielectric body 22.

The one-end-side contact portion 23B is in a right columnar shape having a larger outer diameter than those of the holding target portion 23A-1 and the second shaft portion 23A, and an upper end of the one-end-side contact portion 23B is in a substantially hemispherical shape. Thus, the one-end-side contact portion 23B can easily enter the first receiving hole portion 13-1 of the first coaxial connector 10. The outer diameter of the one-end-side contact portion 23B is slightly larger than the inner diameter of the first receiving hole portion 13-1 in a free state in which the first receiving portion 13B of the first coaxial connector 10 is not elastically deformed, and due to such a diameter difference, the first receiving portion 13 is elastically diameter-expanded.

The other-end-side contact portion 23C downwardly extends in a tubular shape from the second shaft portion 23A toward the third coaxial connector 30 in the axial direction, and a receiving hole 23C-1 opening at a lower end of the other-end-side contact portion 23C in the vicinity of a base portion of the other-end-side contact portion 23C and configured to receive the later-described third center conductor of the third coaxial connector 30 is formed. At such a tubular other-end-side contact portion 23C, slitting grooves 23C-2 opening toward the lower end are formed at four spots in the circumferential direction, and therefore, elastic deformation (diameter narrowing and expansion) in the radial direction is allowed. In the free state without elastic deformation, the lower-end-side inner diameter of the other-end-side contact portion 23C is slightly smaller than the outer diameter of the third center conductor. A tapered surface 23C-3 for guiding the third center conductor is formed at a lower end inner peripheral edge of the other-end-side contact portion 23C. A spacing is formed between an outer peripheral surface of the other-end-side contact portion 23C and an inner diameter surface of the second dielectric body 22, and therefore, diameter expansion upon elastic deformation of the other-end-side contact portion 23C in the radial direction is allowed.

The second center conductor 23 is formed such that the outer diameter of the one-end-side contact portion 23B is larger than the outer diameter of the second shaft portion 23A, and a distance in the radial direction between the one-end-side contact portion 23B and the first fitting portion 11B of the first external conductor 11 is impedance-matched to an impedance between the first center conductor 13 and the periphery thereof and an impedance between the second shaft portion 23A of the second center conductor 23 and the periphery thereof.

As seen from FIG. 6, the third coaxial connector 30 has the metal third external conductor 31, a third dielectric body 32 made of an electric insulating material, and the metal third center conductor 33.

The third external conductor 31 has a third fitting portion 31A configured to receive the other-end-side contact portion 23 of the second coaxial connector 20, and a third holding portion 31B configured to hold the third dielectric body 32 below the third fitting portion 31A.

An outer peripheral surface of the third fitting portion 31A has an equal diameter in the axial direction, but an inner peripheral surface of the third fitting portion 31A has, at a middle portion in the axial direction, an annular locking portion 31A-1 radially protruding inward in a trapezoidal shape. At the start of fitting between the second coaxial connector 20 and the third coaxial connector 30, the locking portion 31A-1 contacts, in the axial direction, the locking protruding portion 21C-1 provided at the lower fitting portion 21C of the second external conductor 21 of the second coaxial connector 20. Upon elastic diameter narrowing of the lower fitting portion 21C, the locking portion 31A-1 allows passage of the locking protruding portion 21C-1. Thereafter, when the lower fitting portion 21C returns to the free state, the locking portion 31A-1 and the locking protruding portion 21C-1 are locked with each other in a detachment direction of the second coaxial connector 20 to prevent detachment of the second coaxial connector 20, and therefore, a so-called lock state is maintained.

The third holding portion 31B is provided with a holding hole 31B-1 for holding the later-described third dielectric body 32, and has a substantially rectangular outer shape as viewed in the axial direction. Moreover, the third holding portion 31B protrudes in the radial direction with respect to the third fitting portion 31A. A recessed groove 31B-2 opening at a bottom surface, extending in the radial direction, and configured to house a later-described third connection portion of the third center conductor 33 is formed at a single spot in the circumferential direction at the third holding portion 31B (see FIG. 3). The bottom surface of the third holding portion 31B forms a third external connection portion 31B-3 to be mounted on the circuit board.

The third dielectric body 32 is held in the holding hole 31B-1 formed at the third holding portion 31B of the third external conductor 31, and holds the later-described third center conductor 33 by a third center conductor holding portion 32A formed at the inner diameter of the third dielectric body 32.

The third center conductor 33 has a base portion 33A to be held by the third center conductor holding portion 32A of the third dielectric body 32, the right columnar third center contact portion 33B extending upwardly from the base portion 33A in the axial direction and entering the receiving hole 23C-1 of the other-end-side contact portion 23C formed at a lower portion of the second center conductor 23 of the second coaxial connector 20, and a third center connection portion 33C extending outwardly from the base portion 33A in the radial direction and housed in the recessed groove 31B-1 of the third holding portion 31B of the third external conductor 31 through the third dielectric body 32 (see FIG. 3).

For the inner diameter of the other-end-side contact portion 23C of the second center conductor 23 of which lower end side has a slightly-smaller inner diameter than the outer diameter of the third center contact portion 33B, the third center contact portion 33B forms a contact area in a local area in the axial direction.

The third center contact portion 33B is in the recessed groove 31B-2 of the third external conductor 31, and a bottom surface of the third center connection portion 33C can be soldered and mounted in contact with the circuit board P2 (see FIG. 1).

The first coaxial connector 10, the second coaxial connector 20, and the third coaxial connector 30 configured as described above are used and function in the following manner.

First, the first coaxial connector 10 is mounted on the circuit board P1 in such a manner that the first external connection portions 11A-3 of the first external conductor 11 and the first center connection portion 13C of the first center conductor 13 are each soldered and connected to corresponding circuit portions formed at the circuit board P1.

Next, the third coaxial connector 30 is mounted on another circuit board P2 in the state of fitting onto the second coaxial connector 20 or a state before fitting. Such mounting is performed in such a manner that the third external connection portion 31B-3 of the third external conductor 31 of the third coaxial connector 30 and the third center connection portion 33C of the third center conductor 33 are each soldered and connected to corresponding circuit portions formed at another circuit board P2. When the third coaxial connector 30 is mounted on the circuit board P2 before fitting onto the second coaxial connector 20, the second coaxial connector 20 is fitted in the third coaxial connector after such mounting.

After the second coaxial connector 20 has been fitted in the third coaxial connector 30, the locking protruding portion 21C-1 provided at the second external conductor 21 of the second coaxial connector 20 is, in the axial direction, locked with the locking portion 31A-1 provided at the third external conductor 31 of the third coaxial connector 30 at a position below the locking portion 31A-1. Accordingly, detachment of the second coaxial connector 20 is prevented, and the so-called lock state is brought.

Next, the first coaxial connector 10 mounted on the circuit board P1 and the second coaxial connector 20 fitted in the lock state in the third coaxial connector 30 mounted on another circuit board P2 are fitted to each other. In the second external conductor 21 of the second coaxial connector 20, the one-end-side contact portion 21B-1 contacts the inner surface of the first fitting portion 11B of the first external conductor 11 of the first coaxial connector 10, and the one-end-side contact portion 23B of the second center conductor 23 of the second coaxial connector 20 contacts the first receiving hole portion 13B-1 formed at the inner surface of the first receiving portion 13B of the first center conductor 13.

In this manner, the circuit board P1 and another circuit board P2 are electrically connected to each other through the first coaxial connector 10, the second coaxial connector 20, and the third coaxial connector 30.

The circuit board P1 and another circuit board P2 might be relatively shifted from a predetermined connection position in the axial direction or a direction at a right angle to the axial direction, i.e., a direction parallel to the planes of the circuit boards P1, P2. Further, the circuit boards P1, P2 might be inclined relative to each other, i.e., the axis of the first coaxial connector 10, the axis of the second coaxial connector 20, and the axis of the third coaxial connector 30 might be inclined relative to each other. In a case where such shift in the axial direction or the direction at the right angle to the axial direction or relative axis inclination occurs, the following technique is taken in the present embodiment.

First, in a case where the circuit boards P1, P2 are shifted from each other in the axial direction, the one-end-side contact portion 21B-1 of the second external conductor 21 of the second coaxial connector 20 slides in the axial direction along the straight inner surface of the first fitting portion 11B of the first coaxial connector 10, and the right columnar one-end-side contact portion 23B of the second center conductor 23 of the second coaxial connector 20 slides in the axial direction along the inner surface of the first receiving portion 13B of the first center conductor 13 of the first coaxial connector 10. Even when such sliding is performed, a spacing in the radial direction between the first external conductor 11 and the second center conductor 23 is not changed at all, and therefore, a connector characteristic impedance is maintained at a predetermined value under such sliding.

Next, in a case where the circuit boards P1, P2 are shifted from each other or are inclined relative to each other in the radial direction, i.e., the direction at the right angle to the axial direction, relative inclination is caused between the first coaxial connector 10 and the second coaxial connector 20, and is further caused between the second coaxial connector 20 and the third coaxial connector 30. Relative shift and inclination of the circuit boards P1, P2 in the direction at the right angle to the axial direction are absorbed.

The first fitting portion 11B of the first external conductor 11 of the first coaxial connector 10 and the one-end-side contact portion 21B-1 of the upper fitting portion 21B of the second coaxial connector 20 form the contact area in the local area in the axial direction, the slitting grooves 21B-2 are formed at the upper fitting portion 21B, and the slitting grooves 13B-2 are formed at the first receiving portion 13B receiving the one-end-side contact portion 23B of the second center conductor 23 of the second coaxial connector 20. With this configuration, the upper fitting portion 21B and the first center conductor 13 are elastically diameter-expanded in response to external force in the direction at the right angle to the axial direction, and about the contact area at the one-end-side contact portion 21B-1 as the point of support, the first coaxial connector 10 and the second coaxial connector 20 can be inclined relative to each other.

Moreover, the lower fitting portion 21C of the second external conductor 21 of the second coaxial connector 20 and the trapezoidal locking portion 31A-1 of the third fitting portion 31A of the third coaxial connector 30 form the contact area in the local area in the axial direction, the slitting grooves 21C-2 are formed at the lower fitting portion 21C, and the slitting grooves 23C-2 are formed at the other-end-side contact portion 23C of the second center conductor 23 of the second coaxial connector 20 receiving the third center contact portion 33 of the third center conductor 33 of the third coaxial connector 30. With this configuration, the lower fitting portion 21C and the third fitting portion 31A are elastically diameter-expanded in response to the external force in the radial direction at the right angle to the axial direction, and about the contact area at the locking portion 31A-1 as the point of support, the second coaxial connector 20 and the third coaxial connector 30 can be inclined relative to each other.

As described above, relative inclination is allowed between the first coaxial connector 10 and the second coaxial connector 20 and between the second coaxial connector 20 and the third coaxial connector 30. Thus, the first and second coaxial connectors 10, 20 and the second and third coaxial connectors 20, 30 form floating structures relatively movable in the axial direction and the radial direction, and therefore, not only relative shift of the circuit boards P1, P2 in the axial direction but also relative shift of the circuit boards P1, P2 in the radial direction, i.e., the direction at the right angle to the axial direction, and relative inclination of the circuit boards P1, P2 can be handled.

The present invention is not limited to the illustrated and described form, and various changes can be made. For example, the second external conductor of the second coaxial connector and the third external conductor of the third coaxial connector may be formed as a single member, the second center conductor of the second coaxial connector and the third center conductor of the third coaxial connector may be formed as a single member, and the second coaxial connector and the third coaxial connector may form a single connector. In such a form, shift or inclination of the first coaxial connector and the second coaxial connector is allowed so that the function of the floating structure can be obtained.

LIST OF REFERENCE NUMERALS

10 first coaxial connector
11 first external conductor
11A first holding portion
11A-3 first external connection portion
11B first fitting portion
12 first dielectric body
13 first center conductor
13B first receiving portion
13C first center connection portion
20 second coaxial connector
21 second external conductor
22 second dielectric body
23 second center conductor
23A second shaft portion
23B one-end-side contact portion
23C other-end-side contact portion
30 third coaxial connector
31 third external conductor
31B-3 third external connection portion
32 third dielectric body
33 third center conductor
33B third center contact portion
33C third center connection portion
P1 circuit board
P2 circuit board

The invention claimed is:

1. A coaxial connector assembly including a first coaxial connector configured such that a first center conductor is held by a first external conductor through a first dielectric body, a second coaxial connector configured such that a second center conductor is held by a second external conductor through a second dielectric body, and a third coaxial connector configured such that a third center conductor is held by a third external conductor through a third dielectric body and configured such that the third coaxial connector is fitted in and connected to the first coaxial connector in a single axial direction through the second coaxial connector, wherein the first center conductor is configured such that a first receiving portion configured to receive the second center conductor of the second coaxial connector is formed in a tubular hole shape extending straight in the axial direction, the first external conductor has a first holding portion configured to hold the first center conductor through the first dielectric body and a first fitting portion protruding toward the second coaxial connector with respect to the first dielectric body and the first center conductor in the axial direction and fitted onto one end portion of the second external conductor of the second coaxial connector, and the first fitting portion is formed with a smaller inner diameter than an inner diameter of the first holding portion, the second center conductor of the second coaxial connector has a second shaft portion held by the second dielectric body in the second external conductor, a columnar one-end-side contact portion protruding toward the first coaxial connector with respect to the second dielectric body and the second external conductor in the axial direction and provided at one end portion of the second center conductor on a first coaxial connector side to fit in the first receiving portion of the first coaxial connector, and the other-end-side contact portion formed at the other end portion of the second center conductor on a third coaxial connector side to fit in a third center contact portion provided at one end portion of the third center conductor of the third coaxial connector, the second center conductor is configured such that an outer diameter of the one-end-side contact portion is formed larger than an outer diameter of the second shaft portion and a distance in a radial direction between the one-end-side contact portion and the first fitting portion of the first external conductor is designed such that an impedance between the first center conductor and a periphery of the first center conductor including an air layer and an impedance between the second shaft portion of the second center conductor and a periphery of the second center conductor including an air layer are impedance-matched, the third coaxial connector is configured such that the third external conductor is fitted onto the other end portion of the second external conductor, the first and second coaxial connectors and the second and third coaxial connectors form floating structures relatively movable in the axial direction and the radial direction, and the third external conductor of the third coaxial connector forms, in cooperation with the second external conductor of the second coaxial connector, a lock mechanism configured to prevent detachment.

2. The coaxial connector assembly according to claim 1, wherein each contact area between the first receiving portion at the first center conductor of the first coaxial connector and the one-end-side contact portion of the second center conductor of the second coaxial connector, between the first fitting portion at the first external conductor of the first coaxial connector and one end portion of the second external conductor of the second coaxial connector, between the other-end-side contact portion of the second center conductor of the second coaxial connector and the third center conductor of the third coaxial connector, and between the other end portion of the second external conductor of the second coaxial connector and the third external conductor of the third coaxial connector has the floating structure allowing inclination about the each contact area as a point of support and formed in a local area in the axial direction.

3. The coaxial connector assembly according to claim 2, wherein one of two members forming each contact area has a slitting groove extending in the axial direction at at least a single spot in a circumferential direction.

4. The coaxial connector assembly according to claim 1, wherein the first coaxial connector is configured such that the first center conductor has a first center connection portion to be soldered and connected to a circuit board and the first external conductor has a first external connection portion to be soldered and connected to the circuit board.

5. The coaxial connector assembly according to claim 1, wherein the third coaxial connector is configured such that the third center conductor has a third center connection portion to be soldered and connected to another circuit board and the third external conductor has a third external connection portion to be soldered and connected to the other circuit board.

6. The coaxial connector assembly according to claim 1, wherein the other-end-side contact portion of the second center conductor is formed in a tubular shape extending straight in the axial direction, and is configured to receive the third center contact portion of the third coaxial connector, and the third center contact portion is formed in a columnar shape.

7. The coaxial connector assembly according to claim 1, wherein an upper end of the one-end-side contact portion is in a substantially hemispherical shape.

8. A coaxial connector assembly including a first coaxial connector configured such that a first center conductor is held by a first external conductor through a first dielectric body, a second coaxial connector configured such that a second center conductor is held by a second external conductor through a second dielectric body, and a third coaxial connector configured such that a third center conductor is held by a third external conductor through a third dielectric body and configured such that the third coaxial connector is fitted in and connected to the first coaxial connector in a single axial direction through the second coaxial connector, wherein the first center conductor is configured such that a first receiving portion configured to receive the second center conductor of the second coaxial connector is formed in a tubular hole shape extending straight in the axial direction, the first external conductor has a first holding portion configured to hold the first center conductor through the first dielectric body and a first fitting portion protruding toward the second coaxial connector with respect to the first dielectric body and the first center conductor in the axial direction and fitted onto one end portion of the second external conductor of the second coaxial connector, and the first fitting portion is formed with a smaller inner diameter than an inner diameter of the first holding portion, the second center conductor of the second coaxial connector has a second shaft portion held by the second dielectric body in the second external conductor, a columnar one-end-side contact portion protruding toward the first coaxial connector with respect to the second dielectric body and the second external conductor in the axial direction and provided at one end portion of the second center conductor on a first coaxial connector side to fit in the first receiving portion of the first coaxial connector, the second center conductor is configured such that an outer diameter of the one-end-side contact portion is formed larger than an outer diameter of the second shaft portion and a distance in a radial direction between the one-end-side contact portion and the first fitting portion of the first external conductor is designed such that an impedance between the first center conductor and a periphery of the first center conductor including an air layer and an impedance between the second shaft portion of the second center conductor and a periphery of the second center conductor including an air layer are impedance-matched, the first and second coaxial connectors form floating structures relatively movable in the axial direction and the radial direction, and the second external conductor of the second coaxial connector and the third external conductor of the third coaxial connector are formed as a single member, the second center conductor of the second coaxial connector and the third center conductor of the third coaxial connector are formed as a single member, and the second coaxial connector and the third coaxial connector form a single connector.

9. The coaxial connector assembly according to claim 8, wherein an upper end of the one-end-side contact portion is in a substantially hemispherical shape.

* * * * *